US008413600B2

(12) United States Patent
Kaye

(10) Patent No.: US 8,413,600 B2
(45) **Date of Patent: *Apr. 9, 2013**

(54) COLLAPSIBLE BOAT WITH INFLATABLE MEMBERS

(75) Inventor: Alex R. Kaye, Atherton, CA (US)

(73) Assignee: Alex R. Kaye and Frances Kaye Trust, Atherton, CA (US)

( * ) Notice: Subject to any disclaimer, the term of this patent is extended or adjusted under 35 U.S.C. 154(b) by 158 days.

This patent is subject to a terminal disclaimer.

(21) Appl. No.: 12/650,340

(22) Filed: Dec. 30, 2009

(65) Prior Publication Data

US 2011/0155042 A1 Jun. 30, 2011

(51) Int. Cl.
*B63B 7/00* (2006.01)

(52) U.S. Cl.
USPC ..... 114/354; 114/345; 248/640; 248/642

(58) Field of Classification Search ..... 114/352, 114/354, 345; 248/640, 642
See application file for complete search history.

(56) References Cited

U.S. PATENT DOCUMENTS

| | | | | | |
|---|---|---|---|---|---|
| 2,346,081 | A | * | 4/1944 | Randrup | 114/354 |
| 2,949,616 | A | | 8/1960 | Desanges | |
| 3,228,043 | A | * | 1/1966 | Hall | 114/354 |
| 3,473,502 | A | | 10/1969 | Wittkamp | |
| 3,931,655 | A | * | 1/1976 | Luscombe | 114/352 |
| 4,282,616 | A | * | 8/1981 | Battershill | 114/354 |
| 4,556,009 | A | | 12/1985 | Kaye | |
| 4,597,355 | A | * | 7/1986 | Kirby | 114/345 |
| 4,660,499 | A | | 4/1987 | Kaye | |
| 4,911,095 | A | * | 3/1990 | Kaye | 114/354 |
| 5,372,085 | A | * | 12/1994 | Kaye | 114/352 |
| 5,524,570 | A | | 6/1996 | Kaye | |
| 5,704,310 | A | * | 1/1998 | Cittadini | 114/354 |
| 6,164,237 | A | | 12/2000 | Coryell et al. | |
| 6,739,278 | B2 | * | 5/2004 | Callahan | 114/354 |

OTHER PUBLICATIONS

International Search Report and Written Opinion mailed on Feb. 14, 2011 for International Application No. PCT/US2010/061349, filed Dec. 20, 2010.

* cited by examiner

*Primary Examiner* — Lars A Olson
(74) *Attorney, Agent, or Firm* — Kilpatrick Townsend & Stockton LLP

(57) ABSTRACT

Collapsible/inflatable boats are disclosed. A collapsible/inflatable boat includes a collapsible hull formed from a plurality of panels that extend from a first end to a second end of the collapsible/inflatable boat. Each of the panels is connected with at least one the other panels. The collapsible hull is configurable between a collapsed configuration and an expanded configuration. A collapsible/inflatable boat can have one or more interior members that are inflatable to support the collapsible hull in the expanded configuration. A collapsible/inflatable boat can have one or more removable solid seats that when installed support the collapsible hull in the expanded configuration. A collapsible/inflatable boat can have an inflatable exterior member connected with the hull such that the exterior member, when inflated, extends around at least a portion of a perimeter of the hull when the hull is in the expanded configuration.

25 Claims, 13 Drawing Sheets

22
42
18
18
18
20
24
14
50
58
54
40
48
38
12
52
56
16
46

COLLAPSIBLE BOAT WITH INFLATABLE MEMBERS

BACKGROUND

Portable boats are popular with, for example, sportsmen and the like. Many such boats are relatively inexpensive and easily transportable, which contribute to their affordability and convenience. Such boats come in a wide range of configurations.

One popular configuration is a rigid boat that includes, for example, a pointed hull having a planar transom or a double-ended hull. Such rigid boats can be fabricated from a range of known materials, for example, polypropylene, aluminum, wood, fiberglass, and the like. Often, such rigid boats include a number of traverse seats.

Another popular configuration is a collapsible boat. Exemplary collapsible boats are disclosed in U.S. Pat. Nos. 4,556,009; 4,660,499; and 5,524,570. Many existing collapsible boats are light enough to be carried by a single person when collapsed.

Another popular configuration is an inflatable boat. Existing inflatable boats have inflatable side members and seats disposed between the inflatable side members.

Because of the continuing need for portable boats, improvements are always sought. Thus, there is believed to be a need for portable boats with enhanced features.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Collapsible boats with one or more inflatable members are provided. The disclosed boats include a plurality of connected hull panels movable to provide a collapsed hull configuration and an expanded hull configuration, and at least one inflatable member. The disclosed boats can include one or more inflatable interior members that when inflated constrain the hull panels in the expanded hull configuration and/or one or more removable solid seats that when installed constrain the hull panels in the expanded hull configuration. The disclosed boats can include one or more inflatable exterior members that distribute additional buoyancy around at least a portion of a perimeter of the hull when the hull is in the expanded configuration. The disclosed boats provide a significant amount of capacity and stability for their size, while being easily transportable in the collapsed configuration. The disclosed boats are relatively light weight, and can often be transported without a boat trailer. In many embodiments, inflatable interior members provide both stabilization of the hull in the expanded condition and seating surfaces. The use of one or more inflatable interior members to stabilize the hull provides significant convenience to the user of the boat by simplifying the deployment process. The use of one or more removable solid seats to stabilize the hull provides for a fast hull deployment process.

Thus, in a first aspect, a boat is provided that includes a collapsible hull having a first end and a second end, and at least one inflatable interior member. The collapsible hull includes a plurality of panels extending between the first end and the second end. Each panel is connected with at least one of the plurality of panels. The hull is configurable between a collapsed configuration and an expanded configuration. The at least one interior member is inflatable to constrain the plurality of panels when the hull is in the expanded configuration.

In many embodiments, the boat includes a flexible diaphragm. The flexible diaphragm can be connected with a rear margin of each panel (disposed to the second end of the boat). The flexible diaphragm can be configured to have a substantially compact configuration when the hull is in the collapsed configuration, and provide a water-tight barrier when the hull is in the expanded configuration.

In many embodiments, the boat includes an inflatable exterior member connected with the hull. The exterior member, when inflated, extends around at least a portion of a perimeter of the hull when the hull is in the expanded configuration.

In many embodiments, the boat includes a removable rigid transom or a folding rigid transom that remains attached when the hull is in the collapsed configuration. A removable transom can be attachable to constrain the panel rear margins when the hull is in the expanded configuration. A folding transom can be positioned to constrain the panel rear margins when the hull is in the expanded configuration. In many embodiments, a rigid transom enables the attachment of an outboard motor.

In many embodiments, the hull panels include a plurality of port-side panels and a plurality of starboard-side panels. For example, the hull panels can include a port side panel, a port bottom panel connected with the port side panel, a starboard bottom panel connected with the port bottom panel, and a starboard side panel connected with the starboard bottom panel.

In many embodiments, the at least one inflatable interior member includes a plurality of traverse members. Each traverse member can connect a port side panel with a starboard side panel to constrain the side panels in the expanded configuration when the traverse members are inflated. At least one of the traverse members can include a seating surface.

In many embodiments, the at least one inflatable interior member includes an inflatable longitudinal member. The longitudinal member can be oriented traverse to the traverse members, disposed between a plurality of the traverse members and the hull, and inflatable to constrain at least one of the panels when the hull is in the expanded configuration.

In many embodiments, an inflatable exterior member is connected with the hull via attachment membranes. For example, a port upper-attachment membrane can be used to connect the inflatable exterior member with an upper edge of a port side panel of the hull. A port lower-attachment membrane can be used to connect the inflatable exterior member with the port side panel below the port side panel upper edge. A port exterior-attachment member can be used to connect the port lower-attachment membrane with the port side panel. A starboard upper-attachment membrane can be used to connect the inflatable exterior member with an upper edge of a starboard side panel of the hull. A starboard lower-attachment membrane can be used to connect the inflatable exterior member with the starboard side panel below the starboard side upper edge. And a starboard exterior-attachment member can be used to connect the starboard lower-attachment membrane with the starboard side panel.

In many embodiments, a connection between an interior inflatable member and a side panel can be aligned with a connection between an exterior inflatable member and the side panel. For example, the boat can include a port interior-attachment member connecting at least one inflatable traverse member with a port side panel at least in part via a fastener used to connect a port exterior-attachment member with the port side panel. The boat can include a starboard interior-attachment member connecting at least one inflatable traverse member with a starboard side panel at least in part via a fastener used to connect a starboard exterior-attachment member with the starboard side panel.

In another aspect, a boat is provided that includes a collapsible hull having a first end and a second end, at least one removable solid seat, and an inflatable exterior member connected with the hull. The collapsible hull includes a plurality of panels extending between the first end and the second end. Each panel is connected with at least one of the plurality of panels. The hull is configurable between a collapsed configuration and a expanded configuration. The exterior member, when inflated, extends around at least a portion of a perimeter of the hull when the hull is in the expanded configuration.

In many embodiments, the boat includes at least one removable solid seat that when installed constrains the plurality of panels when the hull is in the expanded configuration.

In many embodiments, the boat includes a flexible diaphragm. The flexible diaphragm can be connected with a rear margin of each panel (disposed to the second end of the boat). The flexible diaphragm can be configured to have a substantially compact configuration when the hull is in the collapsed configuration, and provide a water-tight barrier when the hull is in the expanded configuration.

In many embodiments, the boat includes a removable rigid transom or a folding rigid transom that remains attached when the hull is in the collapsed configuration. A removable transom can be attachable to constrain the panel rear margins when the hull is in the expanded configuration. A folding transom can be positioned to constrain the panel rear margins when the hull is in the expanded configuration. In many embodiments, a rigid transom enables the attachment of an outboard motor.

In many embodiments, the boat includes a plurality of removable solid seats. When installed, the removable seats constrain the panels when the hull is in the expanded configuration.

In many embodiments, the hull panels include a plurality of port-side panels and a plurality of starboard-side panels. For example, the hull panels can include a port side panel, a port bottom panel connected with the port side panel, a starboard bottom panel connected with the port bottom panel, and a starboard side panel connected with the starboard bottom panel.

In many embodiments, a removable seat includes a seat board and a supporting strut. For example, each removable seat can include a seat board spanning between a port side panel and a starboard side panel when the hull is in the expanded condition, and a strut spanning between the seat board and at least one of the bottom panels.

In many embodiments, the inflatable exterior member is connected with the hull via attachment membranes. For example, a port upper-attachment membrane can be used to connect the inflatable exterior member with an upper edge of a port side panel of the hull. A port lower-attachment membrane can be used to connect the inflatable exterior member with the port side panel below the port side panel upper edge. A port exterior-attachment member can be used to connect the port lower-attachment membrane with the port side panel. A starboard upper-attachment membrane can be used to connect the inflatable exterior member with an upper edge of a starboard side panel of the hull. A starboard lower-attachment membrane can be used to connect the inflatable exterior member with the starboard side panel below the starboard side panel upper edge. And a starboard exterior-attachment member can be used to connect the starboard lower-attachment membrane with the starboard side panel.

In many embodiments, a connection between a removable seat and a side panel can be aligned with a connection between the exterior inflatable member and the side panel. For example, the boat can include a port interior-attachment member connecting at least one of the removable seats with a port side panel at least in part via a fastener used to connect a port exterior-attachment member with the port side panel. The boat can include a starboard interior-attachment member connecting at least one of the removable seats with a starboard side panel at least in part via a fastener used to connect a starboard exterior-attachment member with the starboard side panel.

In another aspect, a boat is provided that includes a collapsible hull having a first end and a second end, a plurality of inflatable traverse members, an inflatable longitudinal member, and an inflatable exterior member. The collapsible hull includes a plurality of panels extending between the first end and the second end. Each panel is connected with at least one of the plurality of panels. The hull is configurable between a collapsed configuration and an expanded configuration. The panels include a port side panel and a starboard side panel. The inflatable traverse members connect the port side panel with the starboard side panel. Each traverse member is inflatable to constrain the side panels when the hull is in the expanded configuration. The inflatable longitudinal member is oriented traverse to the traverse members, disposed between a plurality of the traverse members and the hull, and inflatable to constrain at least one of the panels when the hull is in the expanded configuration. The inflatable exterior member is connected with the hull such that the exterior member, when inflated, extends around at least a portion of a perimeter of the hull when the hull is in the expanded configuration.

In many embodiments, the boat includes one or more additional components at the second end of the boat. For example, the boat can include a removable rigid transom attachable to constrain the panels at the second end of the boat when the hull is in the expanded configuration, and can include a flexible diaphragm configured to have a substantially compact configuration when the hull is in the collapsed configuration and provide a water-tight barrier at the second end of the boat when the hull is in the expanded configuration. The boat can include a folding rigid transom that remains attached when the hull is in the collapsed configuration to constrain the panels at the second end of the boat when the hull is in the expanded configuration.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. The present invention, however, can be practiced without the specific details. Furthermore, well-known features can be omitted or simplified in order not to obscure the embodiment being described.

Collapsible/Inflatable Boat

Figure 1:
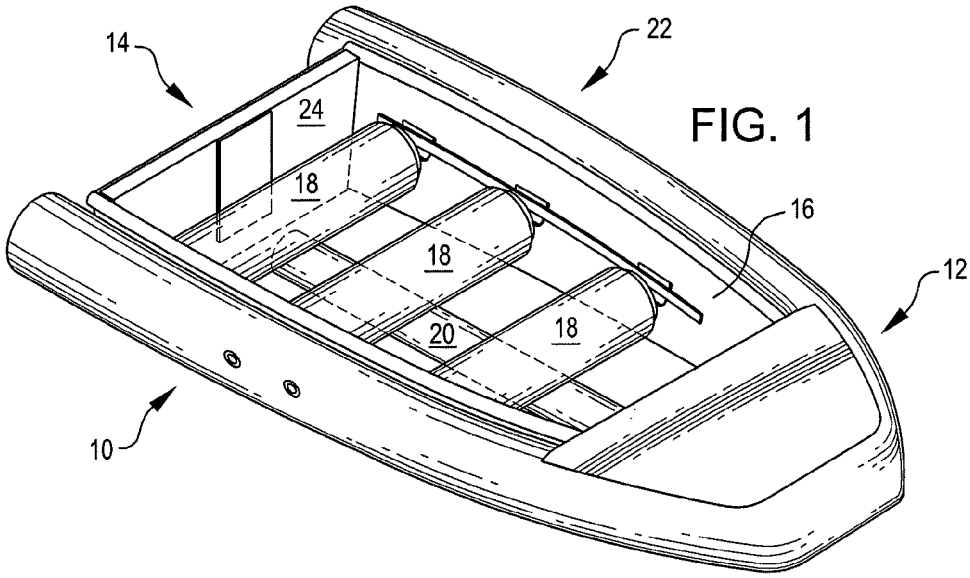
FIG. 1 is a perspective view of a collapsible boat with inflatable members in an expanded and inflated configuration, in accordance with many embodiments.

Referring now to the drawings, in which like reference numerals represent like parts throughout the several views, FIG. 1 shows a collapsible/inflatable boat 10, in accordance with many embodiments. In accordance with embodiments herein, a collapsible/inflatable boat is a boat with a collapsible hull that includes rigid, semi-rigid, or flexible hull panels and one or more interior and/or exterior inflatable members. The hull is a solid, shaped hull that is collapsible or foldable into a storage configuration, and expandable into a use configuration. An exterior inflatable member can take the form of one or more flexible tubes disposed adjacent the gunwale of the boat.

In the embodiment shown in the drawings, the collapsible/inflatable boat 10 has a somewhat pointed bow 12 and a planar stern 14. The collapsible/inflatable boat 10 includes a collapsible hull 16, three inflatable traverse interior members 18, an inflatable longitudinal interior member 20, an exterior assembly 22, and a removable transom 24. The inflatable traverse members 18, in addition to providing internal support to the collapsible hull 16 as described below, further provide passenger seats.

Figure 2:
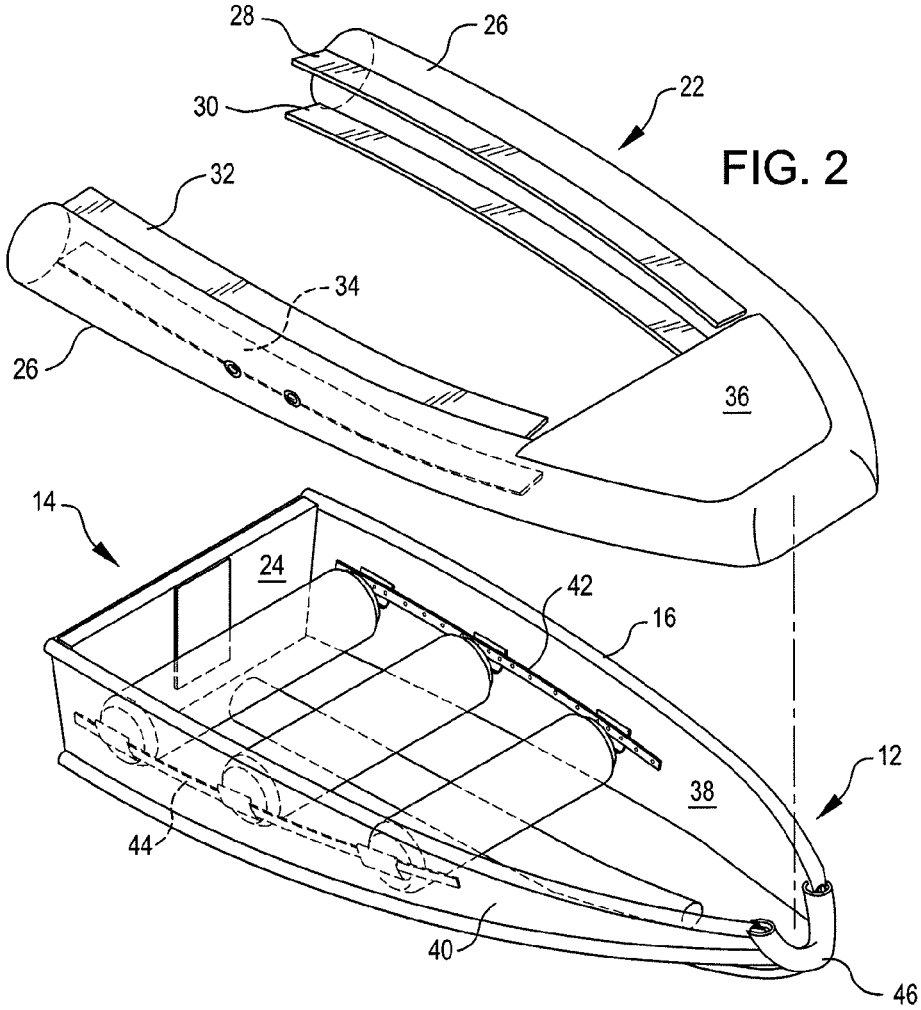
FIG. 2 is an exploded perspective view of the collapsible boat of FIG. 1 that separately illustrates an assembly comprising a collapsible hull and inflatable interior members, and an assembly comprising an exterior inflatable member, in accordance with many embodiments.

FIG. 2 shows the exterior assembly 22 separate from the rest of the collapsible/inflatable boat 10. The exterior assembly 22 includes an inflatable exterior member 26 having a tubular shape and configured to surround a perimeter portion of the hull 16. The exterior assembly 22 includes a port upper-attachment membrane 28, a port lower-attachment membrane 30, a starboard upper-attachment membrane 32, and a starboard lower-attachment membrane 34. The attachment membranes 28, 30, 32, 34 are used to connect the exterior assembly 22 to the collapsible hull 16. The exterior assembly 22 further includes a bow membrane 36 that is attached to the inflatable exterior member 26 at the bow.

The collapsible hull 16 includes a plurality of interconnected panels extending between the bow 12 and the stern 14. The panels can be rigid, semi-rigid, or flexible. The panels are movable between a collapsed configuration and an expanded configuration. When in the expanded configuration, the hull 16 fauns a non-inflatable structural portion of the boat that is water tight. While any suitable number of panels can be used, the hull 16 includes four panels. As will be described in more detail below, the hull 16 includes a pair of interconnected lower or bottom panels and a pair of side panels connected with respective bottom or lower panels. The hull 16 includes a flexible or yieldable diaphragm or flexible transom connected to the stern-side margins of the panels and providing a water-tight barrier when the hull is in the expanded configuration. Details of such a collapsible hull are described in U.S. Pat. No. 5,524,570, the full disclosure of which is hereby incorporated herein by reference. While the details provided therein disclose an embodiment of a collapsible hull, many other collapsible configurations can be used having rigid, semi-rigid, flexible, and/or other solid components that hinge, bend, fold, or otherwise move so that the hull can be configured between a collapsible state and an expanded state. For example, a collapsible hull having a double-ended expanded configuration can be used.

As illustrated in FIG. 2, the three inflatable traverse interior members 18 are connected with a port side panel 38 and a starboard side panel 40 via a port interior-attachment member 42 and a starboard interior-attachment member 44, respectively. When inflated, each of the traverse members 18 provide a column support between the side panels 38, 40, thereby helping to keep the collapsible hull 16 in the expanded configuration. The traverse members 18 also serve as an upper constraint to the inflatable longitudinal interior member 20, which is positioned to interface with the bottom panels of the collapsible hull 16 to provide vertical constraint to the bottom panels along their mutual connection line. The traverse members 18 react vertical loads from the longitudinal member 20 into the side panels 38, 40 via the interior-attachment members 42, 44.

The collapsible/inflatable boat 10 includes bow and stern components. A bow panel end cover 46 is installed over the bow ends of the hull panels and serves to protect the exterior assembly 22 from chaffing damage that may arise from contact and relative motion between the bow ends of the hull panels and the exterior assembly 22. Also, the removable transom 24 is shown in its installed position. The removable transom 24 can be constructed in a variety of ways, for example, as a unitary piece, as a welded metal assembly, etc. A folding rigid transom that remains attached to at least one of the hull panels when the collapsible hull is in the collapsed configuration can be used in place of the removable transom 24. For example, a folding rigid transom can be made by attaching the transom 24 to one of the side panels 38, 40 via a hinge disposed along an edge of the transom 24 that interfaces with one of the side panels 38, 40.

Figure 3:
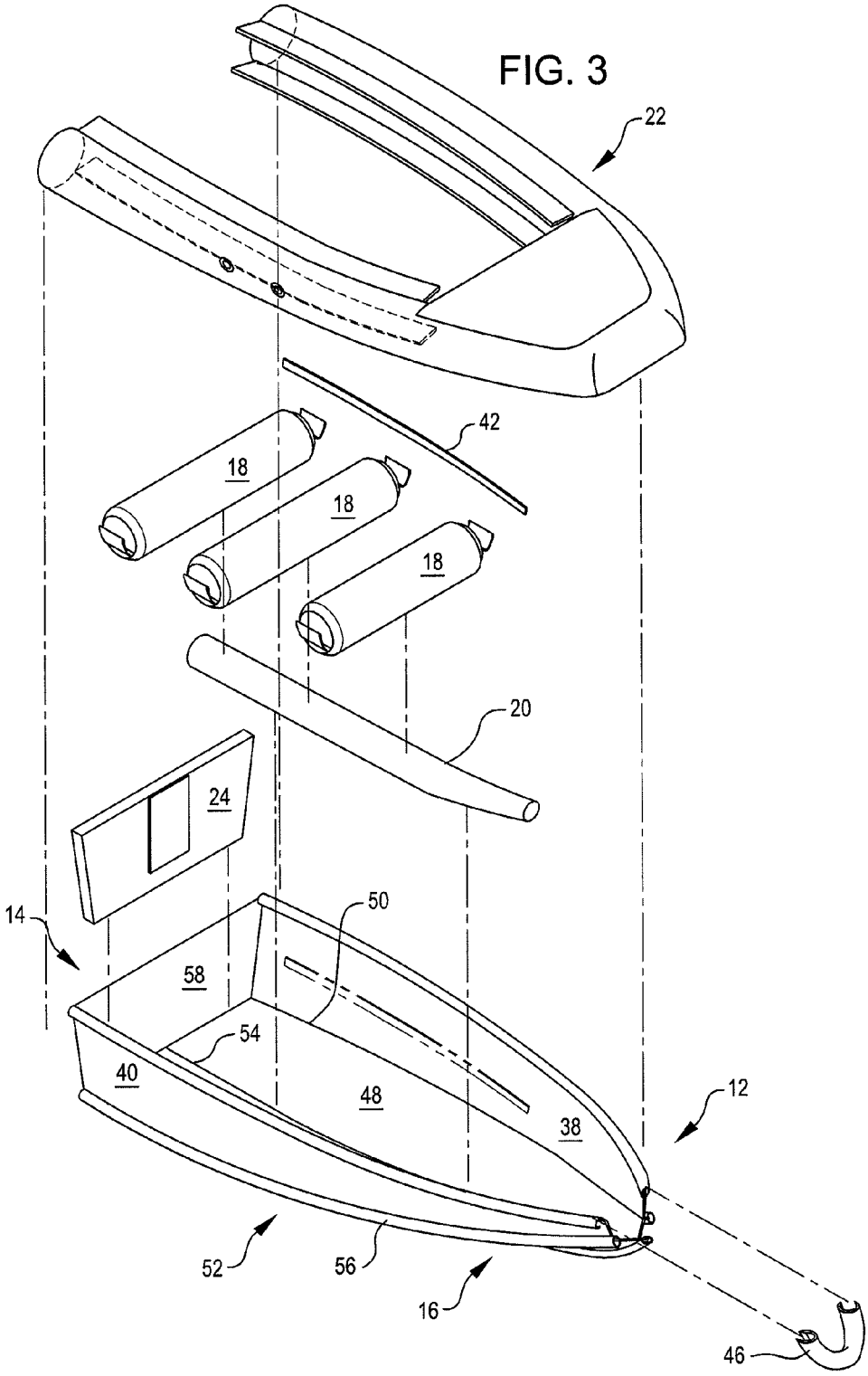
FIG. 3 is an exploded perspective view of the boat of FIG. 1 that separately illustrates the inflatable interior members and a removable transom member, in accordance with many embodiments.

FIG. 3 is an exploded perspective view that separately illustrates the exterior assembly 22, the collapsible hull 16, the inflatable traverse interior members 18, the inflatable longitudinal interior member 20, the bow panel end cover 46, the removable transom 24, and the port-interior attachment member 42. The inflatable longitudinal interior member 20 can be attached to one or more of the traverse interior members 18, or just inserted and held in place between the traverse members 18 and the collapsible hull 16. The collapsible hull 16 includes the port side panel 38, a port bottom panel 48 connected with the port side panel 38 along a connection 50 running between the bow 12 and the stern 14, a starboard bottom panel 52 connected with the port bottom panel 48 along a connection 54 running between the bow 12 and the stern 14, and the starboard side panel 40 connected with the starboard bottom panel 52 along a connection 56 running between the bow 12 and the stern 14. The collapsible hull 16 also includes a flexible diaphragm 58 at the stern 14 that is attached to the stern ends of the hull panels 38, 48, 52, 40 so as to provide a water-tight barrier at the stern 14 when the hull 16 is in the expanded configuration. The flexible diaphragm 58 is configured to have a substantially compact configuration when the collapsible hull 16 is in the collapsed configuration, and to deploy into a substantially planar configuration when the collapsible hull 16 is in the expanded configuration (illustrated in FIG. 3). The removable transom 24 can be inserted into the collapsible hull 16 to constrain the stern ends of the hull panels 38, 48, 52, 40 (panel aft margins) when the hull 16 is in the expanded configuration. The removable transom 24 can be attached to the collapsible hull panels any suitable way. For example, the removable transom 24 can be configured with one or more projections that fit into one or more grooves formed by one or more elongated members bonded to the surfaces of the hull panels such as described in U.S. Pat. No. 5,524,570. The removable transom 24 can also be attached with the panel aft margins using removable fasteners. While the collapsible/inflatable boat 10 includes both the flexible diaphragm 58 and the removable transom 24, one or both of these components can be replaced with a suitable equivalent (e.g., a water-tight removable transom, an inflatable transom, a flexible diaphragm without a removable transom, a folding rigid transom). The removable transom 24 can be made of any suitable solid material of sufficient strength.

Figure 4:
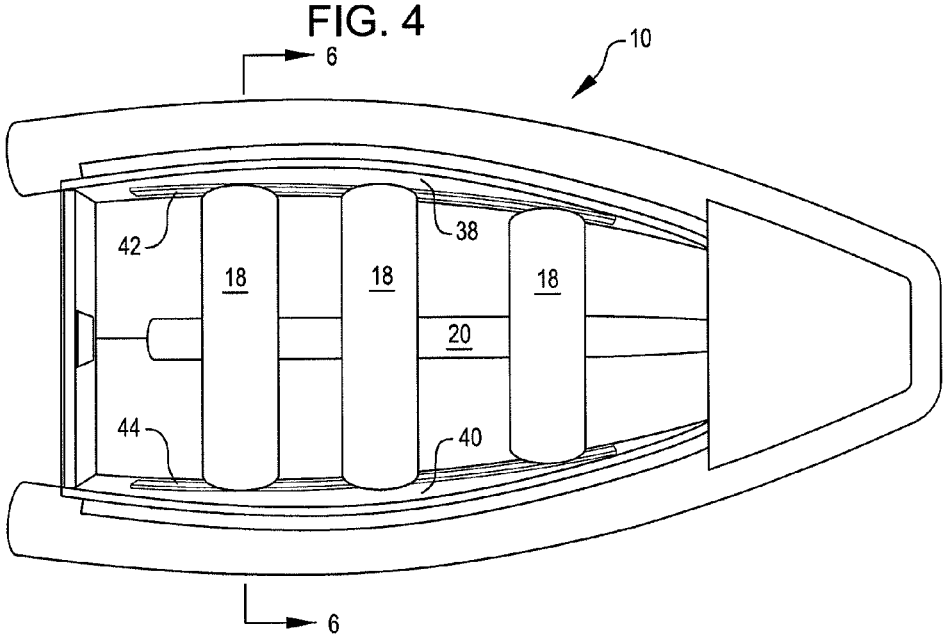
FIG. 4 is a plan view of the boat of FIG. 1 that illustrates the layout of the inflatable interior members, in accordance with many embodiments.

FIG. 4 is a plan view of the collapsible/inflatable boat 10, and illustrates the layout of the inflatable traverse interior members 18 and the inflatable longitudinal interior member 20. Each of the inflatable traverse interior members 18 are connected to the port side panel 38 via the port interior-attachment member 42. And each of the inflatable traverse interior members 18 are connected to the starboard side panel 40 via the starboard interior-attachment member 44.

Figure 5:
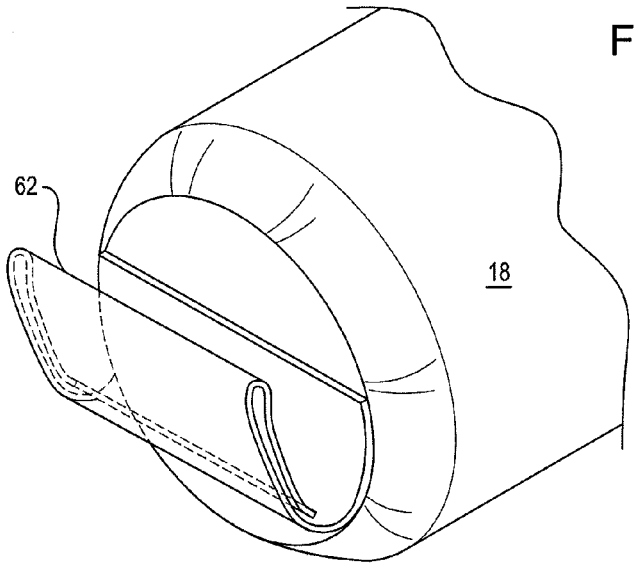
FIG. 5 is a perspective view of an end of an inflatable traverse interior member illustrating an attached membrane for coupling the traverse inflatable member with a side panel of a hull, in accordance with many embodiments.

FIG. 5 illustrates an end of one of the inflatable traverse interior members 18. A side attachment membrane 62 is attached to each end of each traverse member 18. The side attachment membrane 62 can be a rectangular membrane that is attached (e.g., bonded) to the end of the traverse member 18 over an end portion of the side attachment membrane 62. The length of the attachment membrane 62 can be selected to allow the side attachment membrane 62 to be folded into an installation configuration illustrated in FIG. 5.

Figure 6:
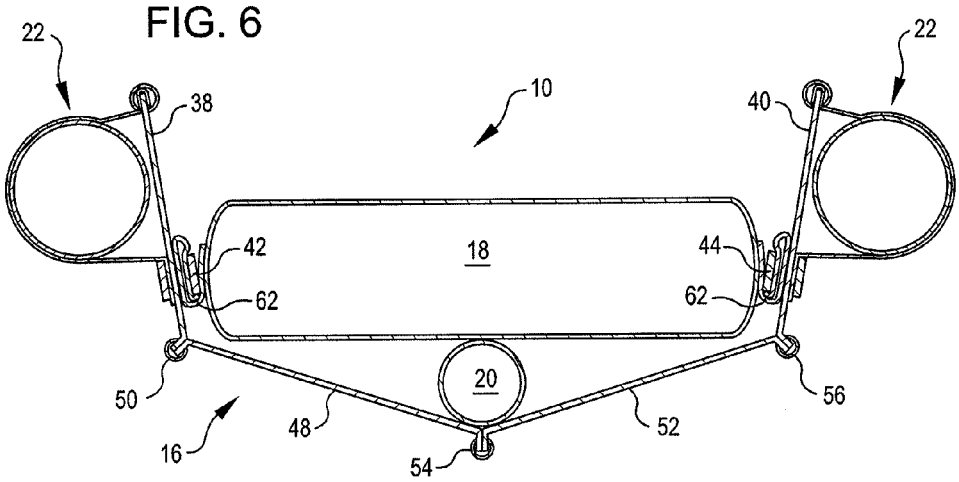
FIG. 6 is a cross-sectional view illustrating a traverse cross-section of the boat of FIG. 1, in accordance with many embodiments.

FIG. 6 illustrates a cross-section 6-6 (as defined in FIG. 4) of the collapsible/inflatable boat 10. The cross-section 6-6 illustrates the collapsible hull 16, one of the inflatable traverse members 18, the inflatable longitudinal member 20, and the exterior assembly 22.

The collapsible hull 16 includes the port side panel 38, the port bottom panel 48 connected with the port side panel 38 along the connection 50 that runs between the bow 12 and the stern 14, the starboard bottom panel 52 connected with the port bottom panel 48 along the connection 54 that runs between the bow 12 and the stern 14, and the starboard side panel 40 connected with the starboard bottom panel 52 along the connection 56 that runs between the bow 12 and the stern 14. The connections 50, 54, 56 can be configured, for example, as described in U.S. Pat. No. 5,524,570. The hull panels can be made from a copolymer material that contains polypropylene, which may be beneficial due to its ability to be folded and unfolded many times without sustaining any significant damage. The hull panels can also be made from aluminum or a plastic material, but may not be as efficient or strong as a polypropylene copolymer material. Neoprene or other similar materials can be used in the connections 50, 54, 56, but do not have the same properties as polypropylene.

Each of the inflatable traverse members 18 is configured to support the collapsible hull in the expanded configuration. Each traverse member 18, when inflated, provides a column support between the port side panel 38 and the starboard side panel 40 that maintains the separation between the side panels 38, 40 in the expanded configuration of the collapsible hull 16. Additionally, each traverse member 18 pushes down on the inflatable longitudinal member 20, which in turn pushes down on the bottom panels 48, 52 along their mutual connection 54 to further help maintain the expanded configuration of the collapsible hull 16. Each traverse member 18 reacts the upward load from the longitudinal member 20 to the port side panel 38 via a side attachment membrane 62 and the port interior-attachment member 42, and to the starboard side panel 40 via a side attachment membrane 62 and the starboard interior-attachment member 44.

The inflatable longitudinal member 20 provides a running support of the bottom panels 48, 52 along their mutual connection 54. The resulting upward load on the longitudinal member 20 is then reacted into the traverse members 18.

Figure 7:
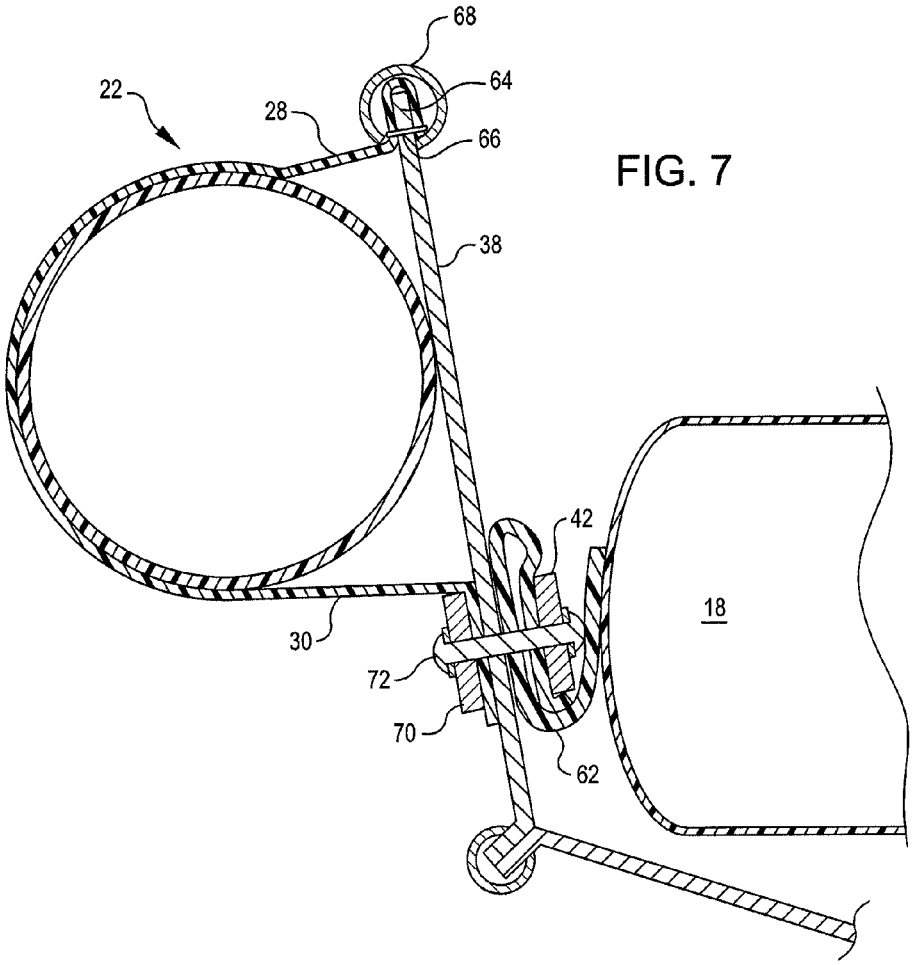
FIG. 7 is a cross-sectional view illustrating the connection of an inflatable exterior member and an inflatable traverse interior member with a side panel of the boat of FIG. 1, in accordance with many embodiments.

FIG. 7 illustrates details of the connection of the exterior assembly 22 with the collapsible hull 16, and details of the connection of one of the traverse members 18 with the collapsible hull 16. While the port side is illustrated, in many embodiments, the corresponding starboard connections are the same as the port connections.

The exterior assembly 22 is connected with the port side of the collapsible hull 16 via the port upper-attachment membrane 28 and the port lower-attachment membrane 30. The port upper-attachment membrane 28 is wrapped over a port side panel upper edge 64 of the port side panel 38 and fastened to the port upper edge 64 using a series of attachment fasteners 66 (e.g., staples). A cover member 68 is installed over the connection between the port upper-attachment membrane 28 and the port upper edge 64, and can serve to stiffen the port upper edge 64 and define a port gunwale for the collapsible hull 16. The port lower-attachment membrane 30 is connected with the port side panel 38 below the port side panel upper edge 64 via a port exterior-attachment member 70 and a series of attachment fasteners 72 (e.g., rivets).

As illustrated, the attachment between the traverse member 18 and the port side panel 38 can be aligned with the connection between the port lower-attachment membrane 30 and the port side panel 38. Such an alignment may serve to reduce the loads imparted into the port side panel 38 by the port lower-attachment membrane 30 by providing a direct load path into the traverse member 18. Such an alignment also enables the use common attachment fasteners 72. The traverse member 18 is connected with the port side panel 38 via a side attachment membrane 62. As illustrated, the side attachment membrane 62 is folded and clamped to the side panel 38 via the port interior-attachment member 42. The folded configuration illustrated places a portion of the side attachment membrane 62 between the port interior-attachment member 42 and the traverse member 18, which helps to protect the traverse member 18 from chaffing damage from contact with and movement relative to the port interior-attachment member 42.

Collapsible/Inflatable Boat with Non-Inflatable Interior Members

Figure 8:
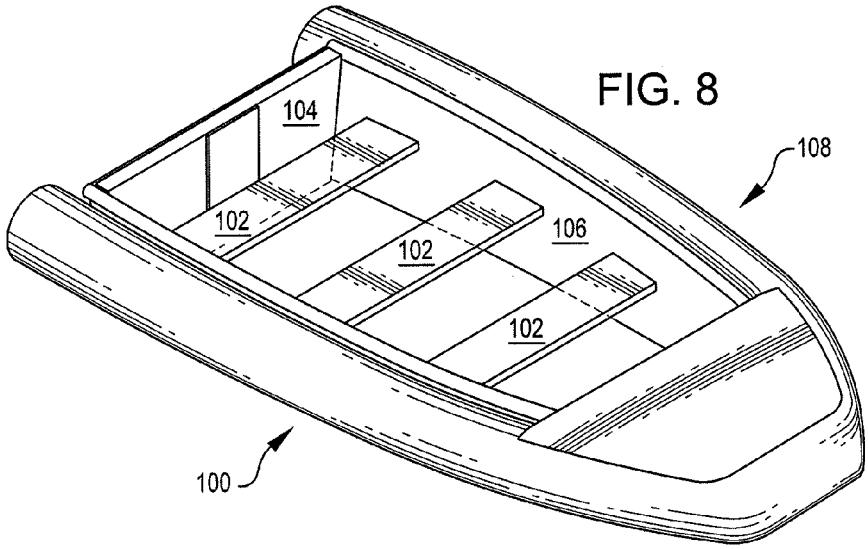
FIG. 8 is a perspective view of a collapsible boat with an inflatable exterior member and non-inflatable removable seats, in accordance with many embodiments.
Figure 9:
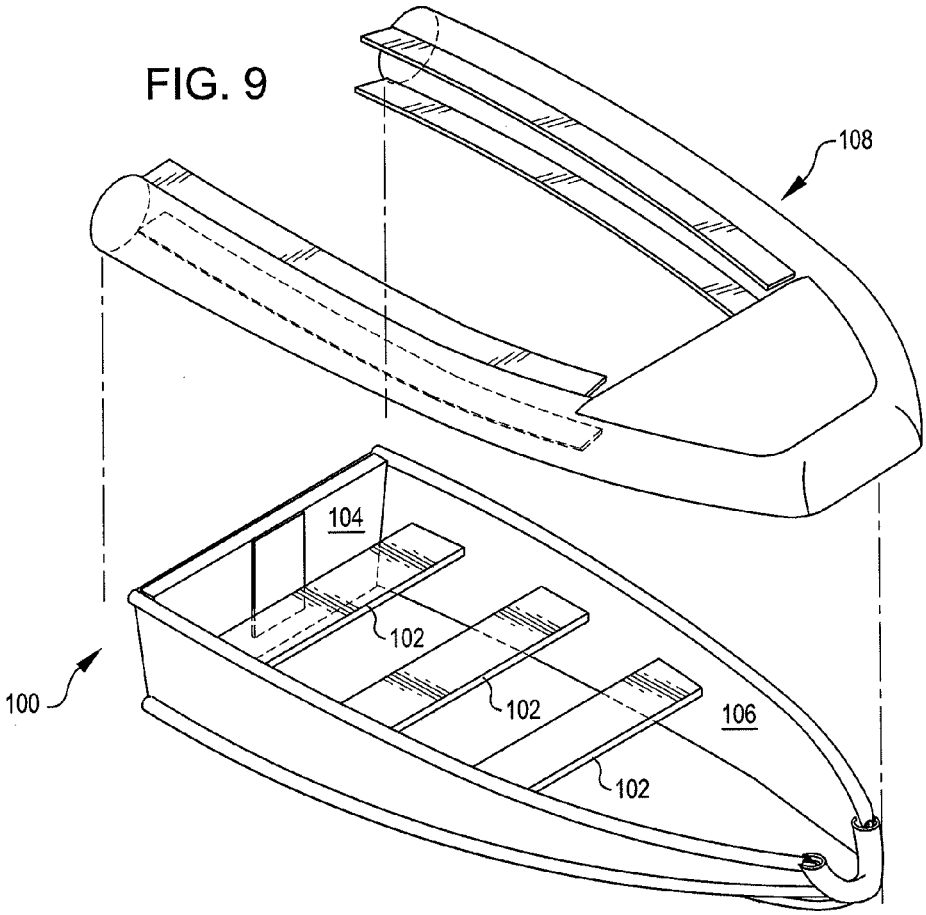
FIG. 9 is an exploded perspective view of the boat of FIG. 8 that separately illustrates an assembly comprising a collapsible hull and removable solid seats, and an assembly comprising an inflatable exterior member, in accordance with many embodiments.

FIG. 8 and FIG. 9 illustrate a collapsible/inflatable boat 100 that employs removable solid seats 102 and a removable transom 104 to support a collapsible hull 106 in an expanded configuration. The collapsible hull 106 can include any suitable feature of the above-described collapsible hull 16. Additionally, the collapsible hull can be configured as described in U.S. Pat. No. 5,524,570. The collapsible/inflatable boat 100 includes an inflatable exterior assembly 108. The exterior assembly 108 can be configured the same as the above-described exterior assembly 22, and can be attached to the collapsible hull 106 the same as described above with regard to the exterior assembly 22 and the collapsible hull 16.

Boat Expansion (Collapsible/Inflatable Boat 10)

Figure 10A:
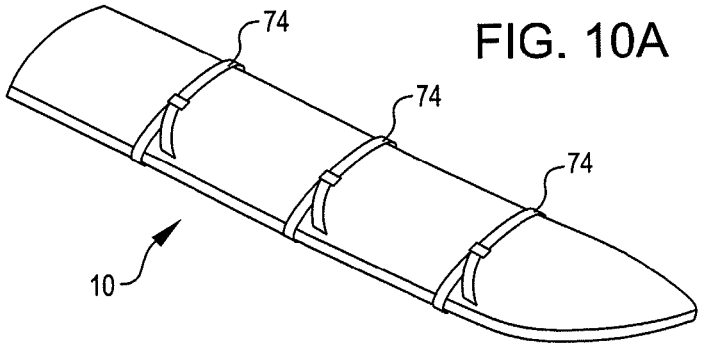
FIG. 10A is a perspective view illustrating the collapsible boat of FIG. 1 in a collapsed configuration, in accordance with many embodiments.

FIG. 10A illustrates the collapsible/inflatable boat 10 of FIG. 1 in the collapsed configuration. When the collapsible/inflatable boat 10 is in the collapsed configuration, the inflatable members 18, 20, 26 are in an un-inflated state and the side panels 38, 40 are folded down over the deflated interior members 18, 20, which are disposed between the down-folded side panels 38, 40 and the bottom panels 48, 52. The flexible diaphragm 58 is also in a collapsed configuration. Straps 74 can be used to constrain the collapsible/inflatable boat 10 in the collapsed configuration. When collapsed, the collapsible/inflatable boat 10 can be carried in a compact, substantially flat condition, for example, on the side or top of a vehicle.

Figure 10B:
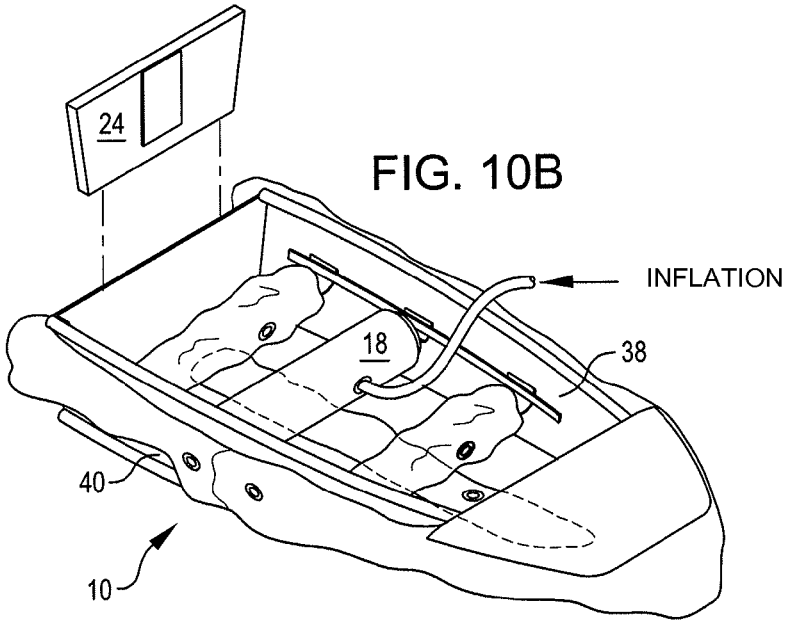
FIG. 10B is a perspective view illustrating the inflation of a first inflatable traverse member and the installation of a removable transom during the expansion process for the boat of FIG. 1, in accordance with many embodiments.
Figure 10C:
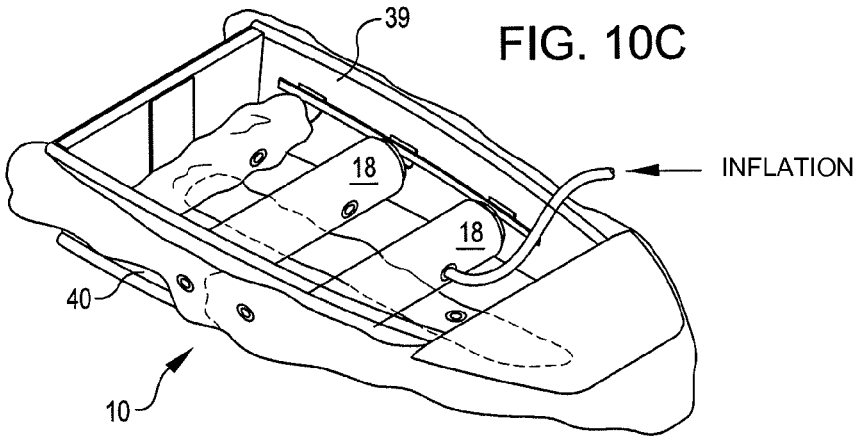
FIG. 10C is a perspective view illustrating the inflation of a second inflatable traverse member during the expansion process for the boat of FIG. 1, in accordance with many embodiments.
Figure 10D:
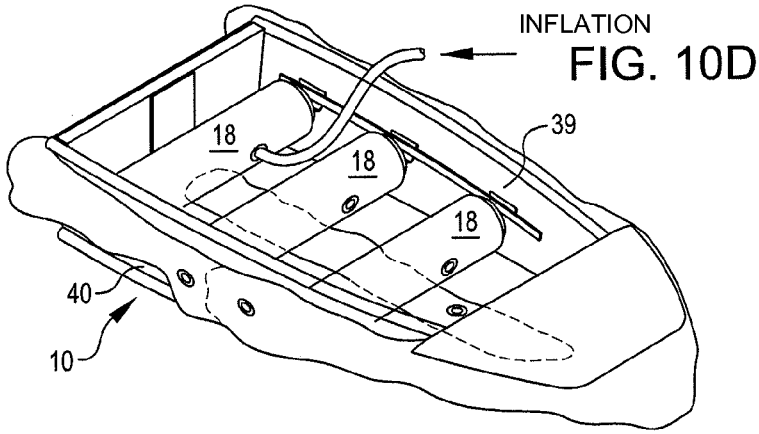
FIG. 10D is a perspective view illustrating the inflation of a third inflatable traverse member during the expansion process for the boat of FIG. 1, in accordance with many embodiments.
Figure 10E:
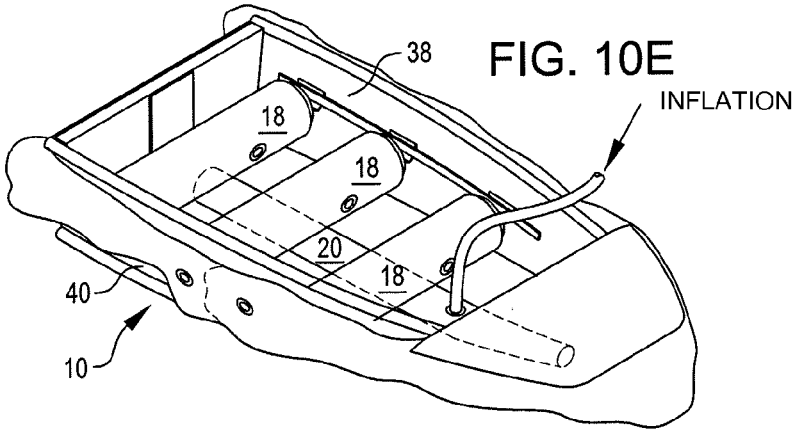
FIG. 10E is a perspective view illustrating the inflation of the inflatable longitudinal member during the expansion process for the boat of FIG. 1, in accordance with many embodiments.
Figure 10F:
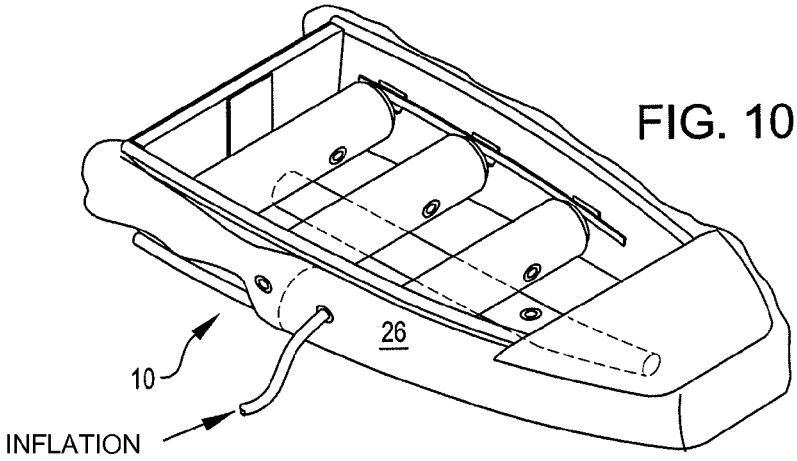
FIGS. 10F through 10H are perspective views illustrating the inflation of the inflatable exterior member during the expansion process for the boat of FIG. 1, in accordance with many embodiments.
Figure 10G:
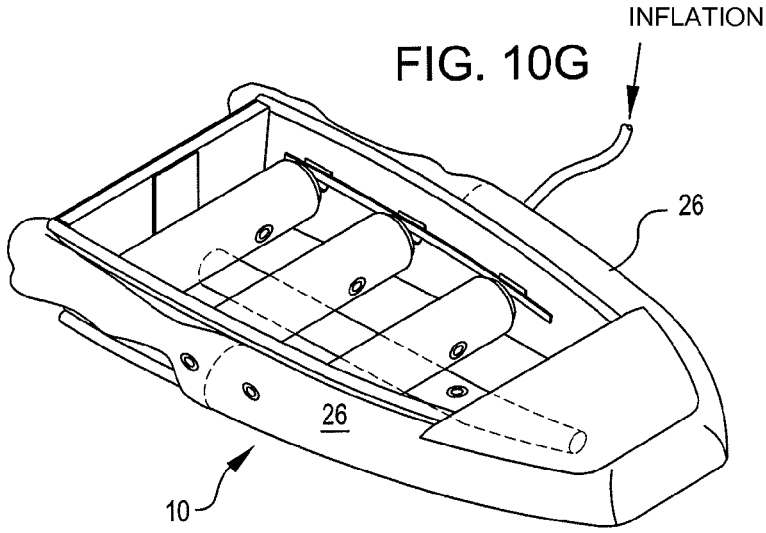
Figure 10H:
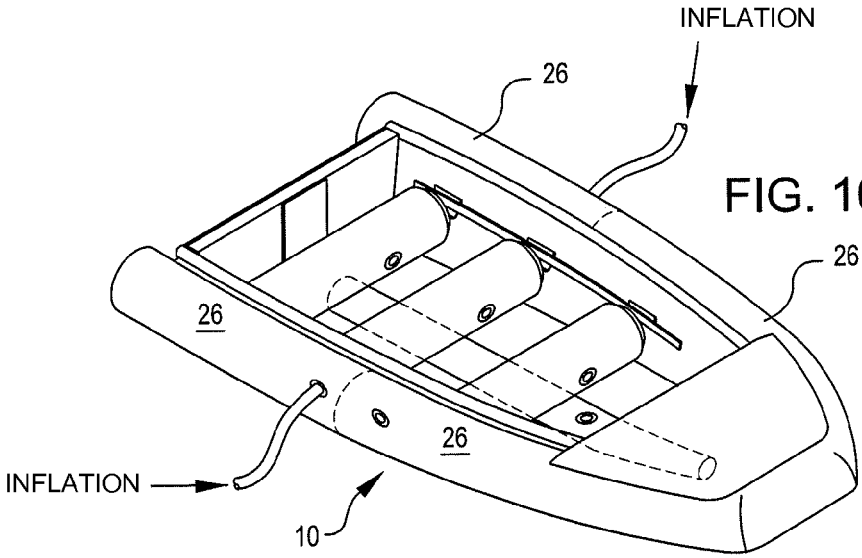

To expand the collapsible/inflatable boat 10, the side panels 38, 40 are moved apart with respect to the bottom panels 48, 52 to provide access to the inflatable interior members 18, 20. Inflation of the interior members 18, 20 reconfigures the collapsible hull 16 into the expanded configuration. Specifically, inflation of the traverse members 18 provides column supports between the side panels 38, 40 so as to maintain the separation between the side panels 38, 40 in the expanded configuration. As illustrated in FIG. 10B, the expansion process can start with the inflation of the center traverse member 18 and the installation of the removable transom 24. Next, the forward traverse member 18 can be inflated as illustrated in FIG. 10C. And then the aft traverse member 18 can be inflated as illustrated in FIG. 10D. Inflation of the longitudinal member 20 as illustrated in FIG. 10E provides the above-described running support of the bottom panels 48, 52. As a result, the inflation of the interior members 18, 20 drives the collapsible hull 16 into the expanded configuration and thereafter maintains the collapsible hull 16 in the expanded configuration. The exterior inflatable member 26 is also inflated during the expansion of the collapsible/inflatable boat 10 as illustrated in FIG. 10F through FIG. 10H. While a specific expansion sequence is illustrated in FIG. 10A through FIG. 10H, the inflation of the interior members 18, 20, the inflation of the exterior member 26, and the installation of the removable transom 24 can be accomplished in any suitable order.

In many embodiments, each of the interior members 18, 20 is a separate inflatable member that is inflated through a separate inflation orifice or valve. As illustrated in FIG. 10F through FIG. 10H, the exterior inflatable member 26 can include one or more separate inflatable portions, each of which can be inflated through a separate inflation orifice or valve. Any suitable inflation means can be used, for example, a hand pump, an electric pump, an air compressor, etc. With a suitable hand pump, the collapsible/inflatable boat 10 can be expanded in about ten minutes to twenty minutes.

The removable transom 24 is also attached during the expansion of the collapsible/inflatable boat 10. While any suitable means of attachment can be used, in many embodiments the removable transom is attached to the panel rear margins using removable fasteners. While the removable transom can be installed on either side of the flexible diaphragm 58, in many embodiments, the transom 24 is installed inside of the flexible diaphragm 58. While the transom 24 can be attached at any point during the expansion of the collapsible/inflatable boat 10, it may be easier to attach the transom 24 after the inflation of at least one of the interior members 18, 20 due to constraint supplied by the inflated interior members 18, 20. On the other hand, it may be easier to inflate the interior members 18, 20 after the attachment of the transom 24 due to the constraint supplied by the transom 24.

Boat Expansion (Collapsible/Inflatable Boat 100)

When the collapsible/inflatable boat 100 is in the collapsed configuration, the inflatable exterior member 26 is in an uninflated state and the side panels of the collapsible hull 106 are folded down over the bottom panels of the collapsible hull 106. The flexible diaphragm of the collapsible hull 106 is also in a collapsed configuration. When collapsed, the collapsible/inflatable boat 100 can be carried in a compact, substantially flat condition, for example, on the side or top of a vehicle.

To expand the collapsible/inflatable boat 100, the side panels are moved apart with respect to the bottom panels and the removable solid seats 102 are put into place between the side panels as shown in FIG. 8 and FIG. 9. Each of the removable solid seats 102 includes a leg or strut (not shown) secured to the underside of the removable solid seat 102 and extending downwardly and snuggly fits into the crevice formed by the connection between the bottom panels along the longitudinal fore and aft connection.

The removable transom 104 is also attached during the expansion of the collapsible/inflatable boat 100. While any suitable means of attachment can be used, in many embodiments the removable transom 104 is attached to the panel rear margins using removable fasteners. While the removable transom 104 can be installed on either side of the flexible diaphragm of the collapsible hull 106, in many embodiments, the transom 104 is installed inside of the flexible diaphragm. While the transom 104 can be attached at any point during the expansion of the collapsible/inflatable boat 100, it may be easier to attach the transom 104 after the installation of at least one of the removable solid seats 102 due to the constraint supplied by the removable solid seats 102.

The inflatable exterior member 26 is also inflated during the expansion of the collapsible/inflatable boat 100. The inflation of the exterior member 26 and the installation of the removable seats 102 can be accomplished in any suitable order.

Installation of an Inflatable Exterior Assembly During Manufacture

Figure 11:
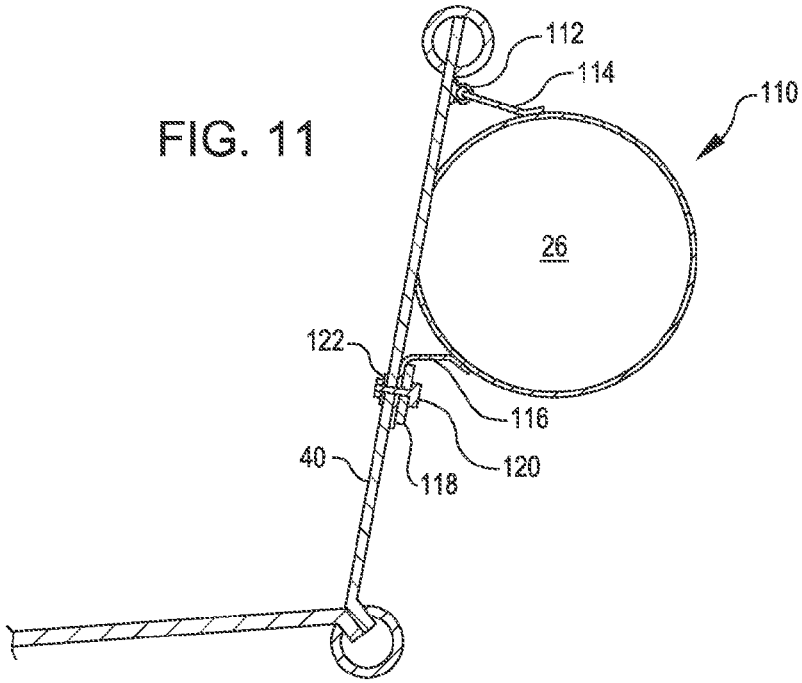
FIG. 11 is a cross-sectional view illustrating the attachment of an inflatable exterior assembly to a starboard-side hull panel at a non-seat location, in accordance with many embodiments.

FIG. 11 through FIG. 23 illustrate configuration details and installation steps for an inflatable exterior assembly 110, in accordance with many embodiments. FIG. 11 is a cross-sectional view illustrating the connection between the inflatable exterior assembly 110 and the starboard-side panel 40 at a non-seat location (e.g., at a location without a corresponding inflatable traverse interior member 18). The top of the inflatable exterior member 26 is attached to the starboard-side panel 40 via an attachment extrusion 112 and a bolt rope 114. The bolt rope 114 includes an edge rope that is slidingly received by the attachment extrusion 112 and a membrane the couples the edge rope with the top of the inflatable exterior member 26. At the bottom end of the inflatable exterior member 26, a lower tube flap 116 is used to couple the inflatable exterior member 26 with the starboard-side panel 40. A plate 118 and a bolt 120 are used to attach the lower tube flap 116 to the starboard-side panel 40. A fender washer 122 is used on the interior side of the starboard-side panel 40 to distribute the clamping force of the bolt 120 over an area of the starboard-side panel 40. In many embodiments, two bolts 120 are used to attach each lower tube flap 116 to the collapsible hull.

Figure 12:
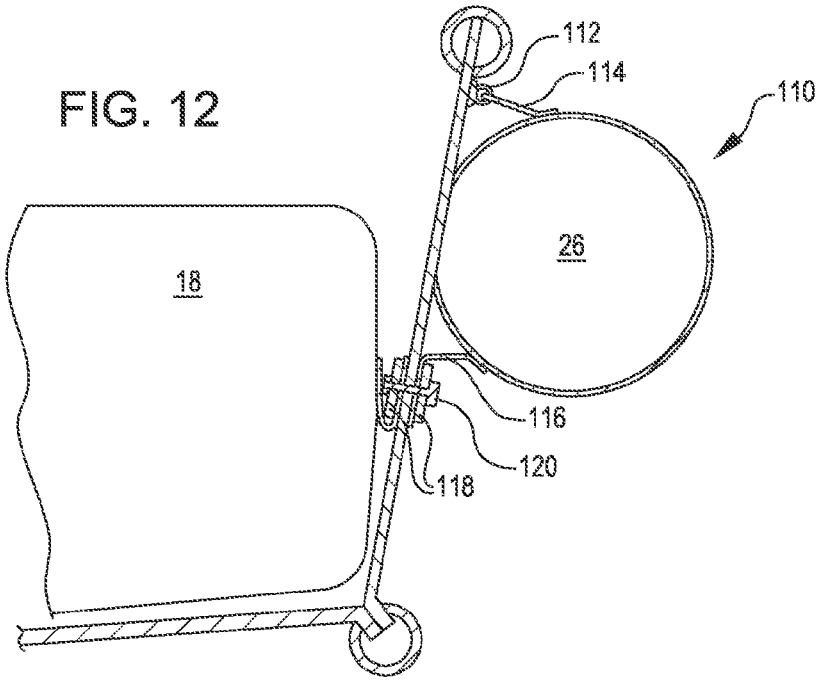
FIG. 12 is a cross-sectional view illustrating the attachment of an inflatable exterior assembly to a starboard-side hull panel at an inflatable traverse member location, in accordance with many embodiments.

FIG. 12 is a cross-sectional view illustrating the connection between the inflatable exterior assembly 110 and the starboard-side panel 40 at a seat location (e.g., at a location with a corresponding inflatable traverse interior member 18). The details of the connection are similar to those shown in FIG. 11, but with the fender washers 122 being replaced by an attachment plate 118 used to attach an attachment flap of the inflatable traverse interior member 18 with the starboard-side panel 40.

Figure 13:
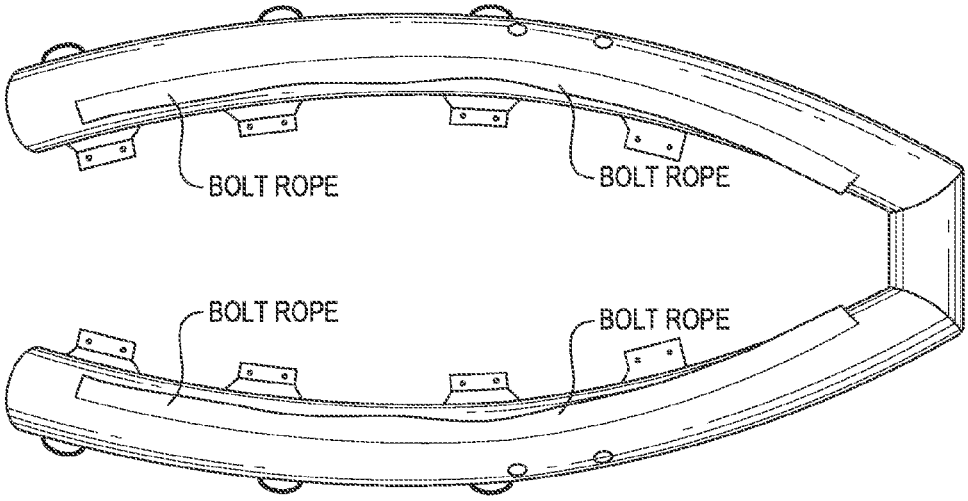
FIG. 13 illustrates an inflatable exterior assembly and shows the location of starboard-side and port-side bolt ropes that connect the top side of the inflatable exterior tube with the port-side and starboard-side hull panels, in accordance with many embodiments.
Figure 14:
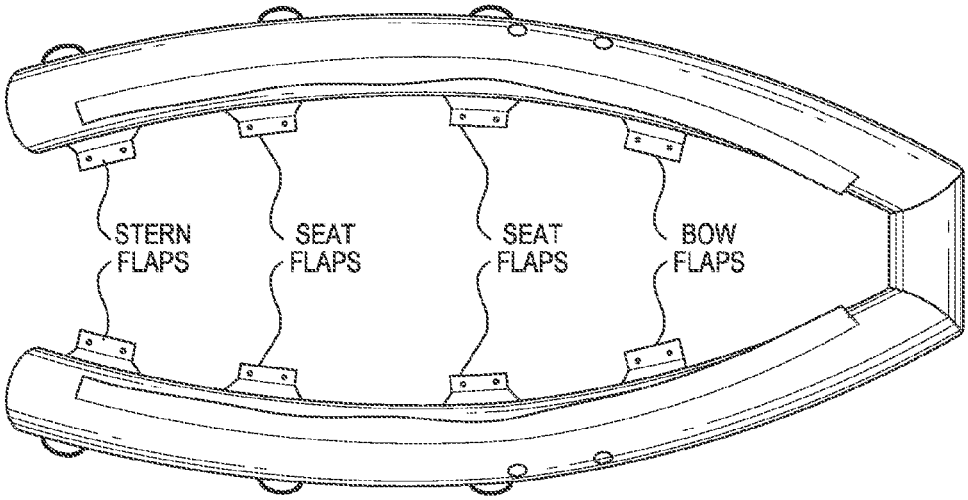
FIG. 14 illustrates an inflatable exterior assembly and shows the location of starboard-side and port-side lower tube flaps that connect the bottom side of the inflatable exterior tube with the port-side and starboard-side hull panels, in accordance with many embodiments.

FIGS. 13 and 14 illustrate the configuration of attachment features of the inflatable exterior assembly 110. For the attachment of the upper end of the inflatable exterior member 26 to the collapsible hull, port-side and starboard-side bolt ropes extend from just adjacent the stern of the inflatable exterior assembly to a location aft of the bow end of the inflatable exterior assembly. For the attachment of the lower end of the inflatable exterior member 26 to the collapsible hull, four port-side lower tube flaps and four starboard-side lower tube flaps are distributed as shown. The port-side and starboard-side lower tube flaps include stern flaps, seat flaps, and bow flaps.

Figure 15:
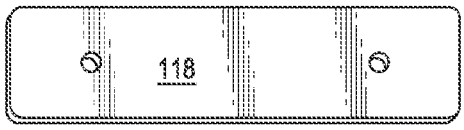
FIG. 15 illustrates an attachment plate used to attach lower tube flaps and inflatable traverse member attachment flaps to a hull panel, in accordance with many embodiments.

FIG. 15 illustrates an attachment plate 118. In many embodiments, an attachment plate 118 is a 2 inch by 8 inch aluminum plate having two attachment holes separated by 5 inches.

Figure 16:
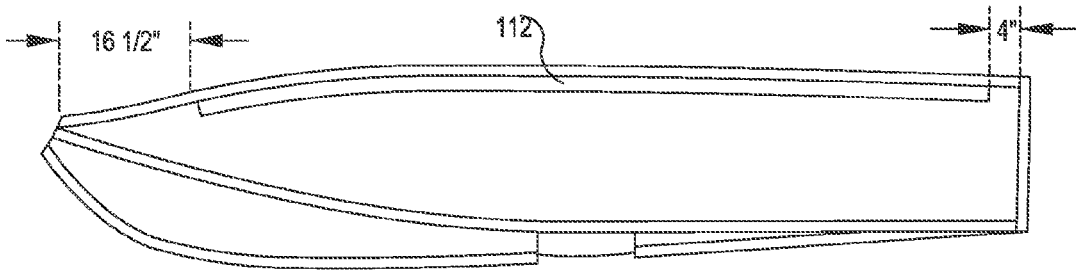
FIG. 16 illustrates the location of an attachment extrusion on a port-side hull panel for coupling with a port-side bolt rope, in accordance with many embodiments.

FIG. 16 illustrates the location of the attachment extrusion 112 on the port-side panel 38. In many embodiments, the attachment of the inflatable exterior assembly 110 to the collapsible hull begins with the attachment of the attachment extrusions 112 to the port and starboard sides of the collapsible hull. In the embodiment illustrated, the attachment extrusion 112 extends from four inches from the stern edge of the collapsible hull to sixteen and one-half inches from the front edge of the collapsible hull. The extrusion 112 can be riveted to the collapsible hull approximately every 4 inches starting 1 inch from each end. In many embodiments, the rivets are oriented to place their manufactured heads on the inside of the hull. The rivet length used can be minimized to reduce or eliminate any potential interference between the rivets and the bolt rope 114.

Figure 17:
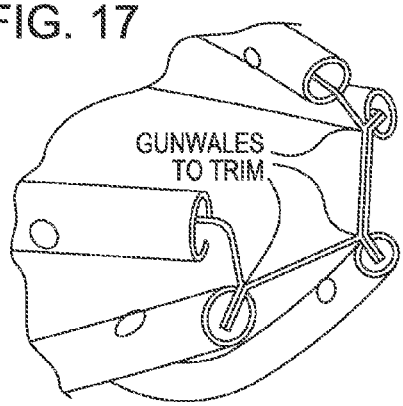
FIG. 17 illustrates gunwale members trimmed to avoid rubbing against an inflatable exterior assembly, in accordance with many embodiments.

FIG. 17 illustrates how the gunwale members of the collapsible hull can be trimmed to reduce or eliminate an potential rubbing against the back of the inflatable exterior assembly 110. While in many embodiments the back of the inflatable exterior assembly 110 is reinforced against rubbing damage, the illustrated end trim of the gunwale members can further help to avoid such rubbing damage.

Figure 18:
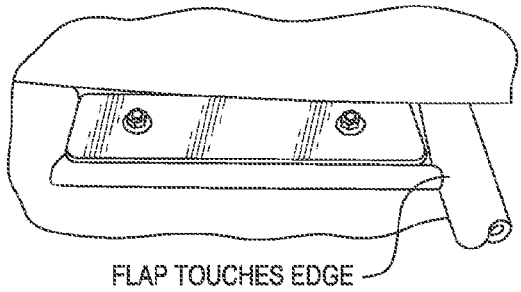
FIG. 18 illustrates the positioning of the inflatable exterior assembly relative to a stern end of the boat, in accordance with many embodiments.

After the installation of the attachment extrusions 112 to the collapsible hull and the trimming of the gunwale members, the attachment extrusions 112 can be lubricated with, for example, soap and water or a commercial lubricant prior to the installation of the port-side and starboard-side bolt ropes 114 into the attachment extrusions 112. The installation of the bolt ropes 114 into the attachment extrusions 112 starts at the bow of the collapsible hull and proceeds towards the stern of the collapsible hull until the stern lower tube flaps 116 are positioned adjacent the stern of the collapsible hull as illustrated in FIG. 18. The installation of the bolt ropes 114 into the attachment extrusions 112 can be accomplished by, for example, starting by sliding about one-half the length of a bolt rope along an attachment extrusion 112 on one side of the hull, and then switching to installing the other side bolt rope 114.

Figure 19:
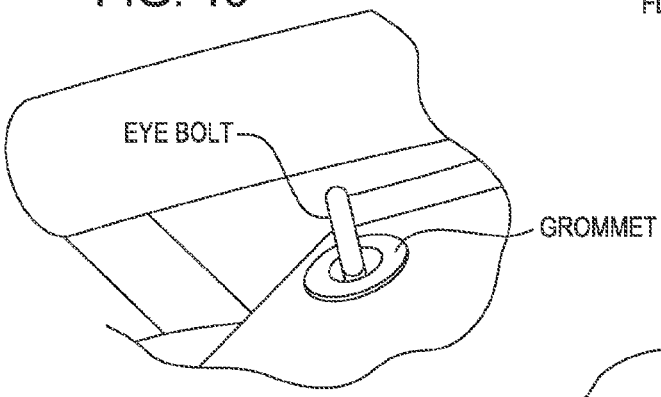
FIG. 19 illustrates the use of an eye bolt and a grommet at a stern end of a connection between a bolt rope of the inflatable exterior assembly and a hull panel, in accordance with many embodiments.

FIG. 19 illustrates the use of an eye bolt and a grommet to further secure the inflatable exterior assembly 110 to the collapsible hull. Port-side and starboard-side holes (e.g., for a one-quarter inch eye bolt) can be drilled in the collapsible hull and fender washers (not shown) can be used to distribute any clamping force over corresponding areas of the port-side and starboard-side hull panels. In many embodiments, the grommets are located adjacent to the port-side and starboard-side bolt ropes 114 at the stern end of the bolt ropes 114 and are attached to the membranes of the bolt ropes 114. These port-side and starboard-side eye bolt connections prevent the bolt ropes 114 from sliding out of the attachment extrusions 112.

Figure 20:
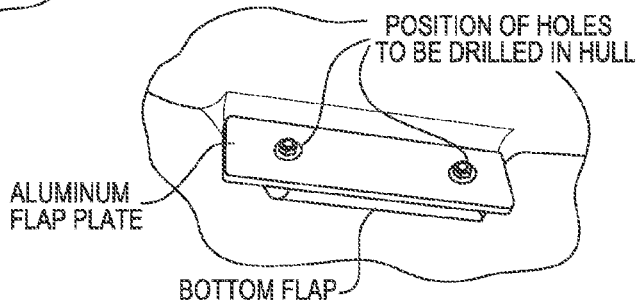
FIG. 20 illustrates the use of an attachment plate to attach a lower tube flap of the inflatable exterior assembly and a hull panel, in accordance with many embodiments.

When the inflatable exterior assembly 110 is in the correct fore/aft position, pre-located holes in the lower tube flaps 116 can be used to determine the location of corresponding mating holes in the collapsible hull. As illustrated in FIG. 20, the vertical position of the holes can be determined by pressing the lower tube flaps 116 against the hull using an attachment plate 118. The resulting vertical position of the holes can be compared with an expected separation from the attachment extrusion 112 such as, for example, approximately eight and one-half inch from the centerline of the attachment extrusion 112. The holes for the center two flaps are also used to attach the seat attachment flaps, so the suitability of these positions relative to the attachment of the seat attachment flaps can be verified prior to drilling the holes in the hull panels. These holes can be, for example, sized to be clearance holes for one-quarter inch bolts (e.g., five-sixteenths inch diameter, three-eights inch diameter).

Figure 21:
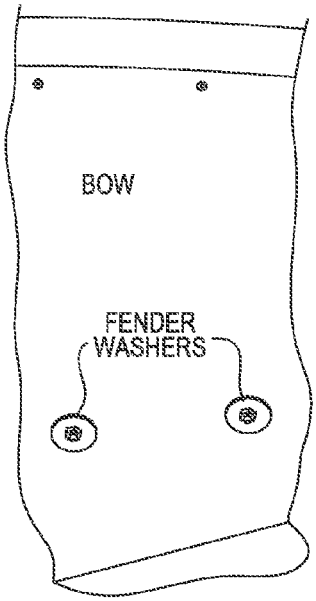
FIG. 21 illustrates the use of fender washers at non-traverse-member attachment locations between a lower tube flap of the inflatable exterior assembly and a hull panel, in accordance with many embodiments.
Figure 22:
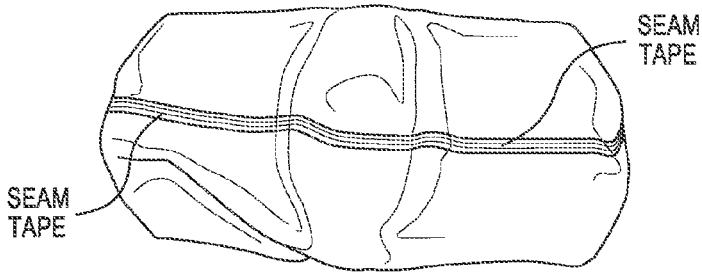
FIG. 22 illustrates a seam on an inflatable interior traverse member used to orient the inflatable interior traverse member during installation, in accordance with many embodiments.
Figure 23:
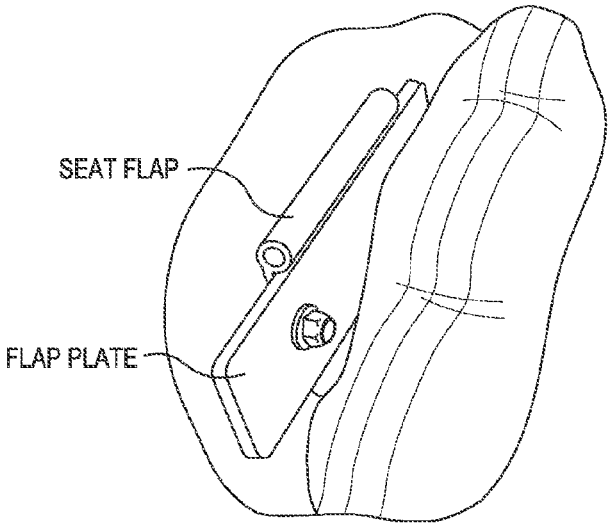
FIG. 23 illustrates a connection between an inflatable interior traverse member and a hull panel, in accordance with many embodiments.

In many embodiments, each lower tube flap 116 and each attachment flap for the inflatable traverse members 18 are attached to the collapsible hull by an attachment plate 118. In many embodiments, the attachment plates 118 are black anodized aluminum plates for resistance against oxidation. For the bow and stern lower tube flaps 116, the attachment bolts 120 are installed with washers through the holes in the attachment plate 118, through the holes in the lower tube flaps 116, through the holes in the hull panel, through the fender washers 112 (as shown in FIG. 21), and secured with self-locking nuts. For the two center lower tube flaps 116, a corresponding deflated inflatable traverse member 18 can be positioned opposite each lower tube flap 116 and can be oriented so that a seam (shown in FIG. 22) in the inflatable traverse member 18 faces the collapsible hull. One of the attachment plates 118 can be used to align the holes in the seat flaps with the holes in the hull, and an attachment bolt 120 with a regular washer installed can be inserted in each of these holes (resulting in the configuration illustrated in FIG. 23). On the exterior side of the hull panel, the lower tube flap 116 can be placed over the bolts, an attachment plate 118 placed over the lower tube flap 116, and secured with regular washers and self-locking nuts. In many embodiments, stainless steel hex head bolts are used as the attachment bolts 120, and their length(s) selected to minimize excess bolt length beyond the nut to reduce or eliminate possible chafing of the exterior inflatable assembly 110.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A boat comprising:

a collapsible hull having a first end and a second end, the hull comprising a plurality of panels extending between the first end and the second end, each panel connected with at least one of the plurality of panels, each panel having a rear margin disposed to the second end of the boat, the panels including a port side panel and a starboard side panel, the hull being configurable between a collapsed configuration and an expanded configuration;

at least one inflatable interior member extending transverse to and connected to the port and starboard side panels to constrain the side panels in the expanded configuration when the at least one inflatable interior member is inflated; and a flexible diaphragm connected with the panel rear margins and configured to have a substantially compact configuration when the hull is in the collapsed configuration, and provide a water-tight barrier when the hull is in the expanded configuration.

2. A boat comprising:

a collapsible hull having a first end and a second end, the hull comprising a plurality of panels extending between the first end and the second end, each panel connected with at least one of the plurality of panels, each panel having a rear margin disposed to the second end of the boat, the panels including a port side panel and a starboard side panel, the hull being configurable between a collapsed configuration and an expanded configuration;

at least one inflatable interior member extending transverse to and connected to the port and starboard side panels to constrain the side panels in the expanded configuration when the at least one inflatable interior member is inflated; and a removable rigid transom attachable to constrain the panel rear margins when the hull is in the expanded configuration.

3. A boat comprising:

a collapsible hull having a first end and a second end, the hull comprising a plurality of panels extending between the first end and the second end, each panel connected with at least one of the plurality of panels, each panel having a rear margin disposed to the second end of the boat, the panels including a port side panel and a starboard side panel, the hull being configurable between a collapsed configuration and an expanded configuration;

at least one inflatable interior member extending transverse to and connected to the port and starboard side panels to constrain the side panels in the expanded configuration when the at least one inflatable interior member is inflated; and a folding rigid transom that remains attached when the hull is in the collapsed configuration to constrain the panel rear margins when the hull is in the expanded configuration.

4. A boat comprising:

a collapsible hull having a first end and a second end, the hull comprising a plurality of panels extending between the first end and the second end, each panel connected with at least one of the plurality of panels, the panels including a port side panel and a starboard side panel, the hull being configurable between a collapsed configuration and an expanded configuration;

at least one inflatable interior member extending transverse to and connected to the port and starboard side panels to constrain the side panels in the expanded configuration when the at least one inflatable interior member is inflated; and an inflatable exterior member connected with the hull such that the exterior member, when inflated, extends around at least a portion of a perimeter of the hull when the hull is in the expanded configuration.

5. The boat of claim 4, wherein the connection between the inflatable exterior member and the hull comprises:

a port upper-attachment membrane connecting the inflatable exterior member with an upper edge of the port side panel of the hull;

a port lower-attachment membrane connecting the inflatable exterior member with the port side panel below the port side panel upper edge;

a starboard upper-attachment membrane connecting the inflatable exterior member with an upper edge of the starboard side panel of the hull; and a starboard lower-attachment membrane connecting the inflatable exterior member with the starboard side panel below the starboard side panel upper edge.

6. The boat of claim 5, further comprising:

a port exterior-attachment member connecting the port lower-attachment membrane with the port side panel; and a starboard exterior-attachment member connecting the starboard lower-attachment membrane with the starboard side panel.

7. The boat of claim 6, wherein the at least one inflatable interior member comprises a plurality of transverse members, each transverse member connecting the port side panel with the starboard side panel to constrain the side panels in the expanded configuration when the transverse members are inflated.

8. The boat of claim 7, further comprising:

a port interior-attachment member connecting at least one of the transverse members with the port side panel at least in part via a fastener used to connect the port exterior-attachment member with the port side panel; and a starboard interior-attachment member connecting at least one of the transverse members with the starboard side panel at least in part via a fastener used to connect the starboard exterior-attachment member with the starboard side panel.

9. A boat comprising:

a collapsible hull having a first end and a second end, the hull comprising a plurality of panels extending between the first end and the second end, each panel connected with at least one of the plurality of panels, the panels including a port side panel and a starboard side panel, the hull being configurable between a collapsed configuration and an expanded configuration; and at least one inflatable interior member extending transverse to and connected to the port and starboard side panels to constrain the side panels in the expanded configuration when the at least one inflatable interior member is inflated, wherein the panels comprise a port bottom panel connected with the port side panel and a starboard bottom panel connected with the port bottom panel and the starboard side panel.

10. The boat of claim 9, wherein the at least one inflatable interior member comprises a plurality of transverse members, each transverse member connecting the port side panel with the starboard side panel to constrain the side panels in the expanded configuration when the transverse members are inflated.

11. The boat of claim 10, wherein at least one of the transverse members comprises a seating surface.

12. The boat of claim 10, wherein the at least one inflatable interior member comprises a longitudinal member that is oriented transverse to the transverse members, disposed between a plurality of the transverse members and the hull, and inflatable to constrain at least one of the panels when the hull is in the expanded configuration.

13. A boat comprising:

a collapsible hull having a first end and a second end, the hull comprising a plurality of panels extending between the first end and the second end, each panel connected with at least one of the plurality of panels and having a rear margin disposed to the second end of the boat, the hull being configurable between a collapsed configuration and an expanded configuration;

a flexible diaphragm connected with the panel rear margins, the flexible diaphragm configured to have a substantially compact configuration when the hull is in the collapsed configuration and provide a water-tight barrier when the hull is in the expanded configuration; and an inflatable exterior member connected with the hull such that the exterior member, when inflated, extends around at least a portion of a perimeter of the hull when the hull is in the expanded configuration.

14. The boat of claim 13, further comprising at least one removable solid seat that when installed constrains the plurality of panels when the hull is in the expanded configuration.

15. The boat of claim 13, further comprising a removable rigid transom attachable to constrain the panel rear margins when the hull is in the expanded configuration.

16. The boat of claim 13, further comprising a folding rigid transom that remains attached when the hull is in the collapsed configuration to constrain the panel rear margins when the hull is in the expanded configuration.

17. The boat of claim 13, further comprising a plurality of removable solid seats that when installed constrain the panels when the hull is in the expanded configuration.

18. The boat of claim 17, wherein:

the panels comprise a port side panel, a port bottom panel connected with the port side panel, a starboard bottom panel connected with the port bottom panel, and a starboard side panel connected with the starboard bottom panel; and each of the removable seats comprises a seat board spanning between the port side panel and the starboard side panel when the hull is in the expanded condition, and a strut spanning between the seat board and at least one of the bottom panels.

19. The boat of claim 13, wherein the connection between the inflatable exterior member and the hull comprises:

a port upper-attachment membrane connecting the inflatable exterior member with an upper edge of a port side panel of the hull;

a port lower-attachment membrane connecting the inflatable exterior member with the port side panel below the port side panel upper edge;

a starboard upper-attachment membrane connecting the inflatable exterior member with an upper edge of a starboard side panel of the hull; and a starboard lower-attachment membrane connecting the inflatable exterior member with starboard side panel below the starboard side panel upper edge.

20. The boat of claim 19, further comprising:

a port exterior-attachment member connecting the port lower-attachment membrane with the port side panel; and a starboard exterior-attachment member connecting the starboard lower-attachment membrane with the starboard side panel.

21. The boat of claim 20, further comprising:

a port interior-attachment member connecting at least one of the removable seats with the port side panel at least in part via a fastener used to connect the port exterior-attachment member with the port side panel; and a starboard interior-attachment member connecting at least one of the removable seats with the starboard side panel at least in part via a fastener used to connect the starboard-exterior attachment member with the starboard side panel.

22. A boat comprising:

a collapsible hull having a first end and a second end, the hull comprising a plurality of panels extending between the first end and the second end, each panel connected with at least one of the plurality of panels, the hull configurable between a collapsed configuration and an expanded configuration, the panels comprising a port side panel and a starboard side panel;

a plurality of inflatable transverse members connecting the port side panel with the starboard side panel, each transverse member inflatable to constrain the side panels when the hull is in the expanded configuration;

an inflatable longitudinal member that is oriented transverse to the transverse members, disposed between a plurality of the transverse members and the hull, and inflatable to constrain at least one of the panels when the hull is in the expanded configuration; and an inflatable exterior member connected with the hull such that the exterior member, when inflated, extends around at least a portion of a perimeter of the hull when the hull is in the expanded configuration.

23. The boat of claim 22, further comprising a removable rigid transom attachable to constrain the panels at the second end of the boat when the hull is in the expanded configuration.

24. The boat of claim 22, further comprising a flexible diaphragm configured to have a substantially compact configuration when the hull is in the collapsed configuration and provide a water-tight barrier at the second end of the boat when the hull is in the expanded configuration.

25. The boat of claim 22, further comprising a folding rigid transom that remains attached when the hull is in the collapsed configuration to constrain the panels at the second end of the boat when the hull is in the expanded configuration.

* * * * *